US005350180A

United States Patent [19]

Acock

[11] Patent Number: 5,350,180

[45] Date of Patent: Sep. 27, 1994

[54] REMOTELY CONTROLLED TARGET SYSTEM WITH OPTIONALLY SELECTIBLE POWER DRIVES SUCH AS FLUID PRESSURE AND ELECTRICAL POWER DRIVES

[76] Inventor: Joseph Acock, 250 S. Sprague Rd., Coldwater, Mich. 49036

[21] Appl. No.: 98,597

[22] Filed: Jul. 28, 1993

[51] Int. Cl.[5] ..... F41J 7/00

[52] U.S. Cl. ..... 273/406

[58] Field of Search ..... 273/406, 407, 410

[56] References Cited

U.S. PATENT DOCUMENTS

| | | | |
|---|---|---|---|
| 3,348,843 | 10/1967 | Stanley | 273/406 |
| 3,614,102 | 10/1971 | Nikoden | 273/406 |
| 3,914,879 | 10/1975 | Taylor, III et al. | 273/406 X |
| 4,189,147 | 2/1980 | Schmid | 273/406 |
| 4,288,080 | 9/1981 | Laporte et al. | 273/406 |
| 4,501,427 | 2/1985 | Payne | 273/406 |
| 4,540,182 | 9/1985 | Clement | 273/406 X |
| 4,743,032 | 5/1988 | Summers et al. | 273/406 X |
| 5,088,741 | 2/1992 | Simonetti | 273/410 |
| 5,163,689 | 11/1992 | Bateman | 273/406 |

FOREIGN PATENT DOCUMENTS

| | | |
|---|---|---|
| 1200173 | 9/1965 | Fed. Rep. of Germany . |
| 1465554 | 12/1966 | France . |
| 608759 | 3/1959 | Italy . |

*Primary Examiner*—William H. Grieb

*Attorney, Agent, or Firm*—McCaleb, Lucas & Brugman

[57] ABSTRACT

A target system having a plurality of flat target boards mounted on posts which are rotatably journaled on an elongated base. Each post is rotatable ninety degrees. A drive crank arm is pivoted to the base for horizontal swinging movement and is pivotally connected to an elongated drive and synchronizing bar which in turn is pivotally connected to a plurality of lever arms connected to the respective posts to swing the target boards simultaneously between full view positions easily visible to a shooter, and edge view positions not visible to the shooter. A superior degree of reliability results from optionally selectible, multiple power drives applied to the single drive crank arm. Optional, ground-supported and overhead-supported embodiments are disclosed. In the embodiments shown, two drives with completely different power sources are shown, one being fluid pressure, the other being electricity. These are in a compact, over-and-under relation. Separate release mechanisms are provided for the two power drives to prevent either drive from restricting movement of the target boards when the other drive is activated. One release mechanism is adjustable to release the electrical power drive when the target boards are swung by the fluid pressure power drive, and another release mechanism is adjustable to release the fluid pressure power drive when the target boards are swung by the electrical power drive.

16 Claims, 9 Drawing Sheets

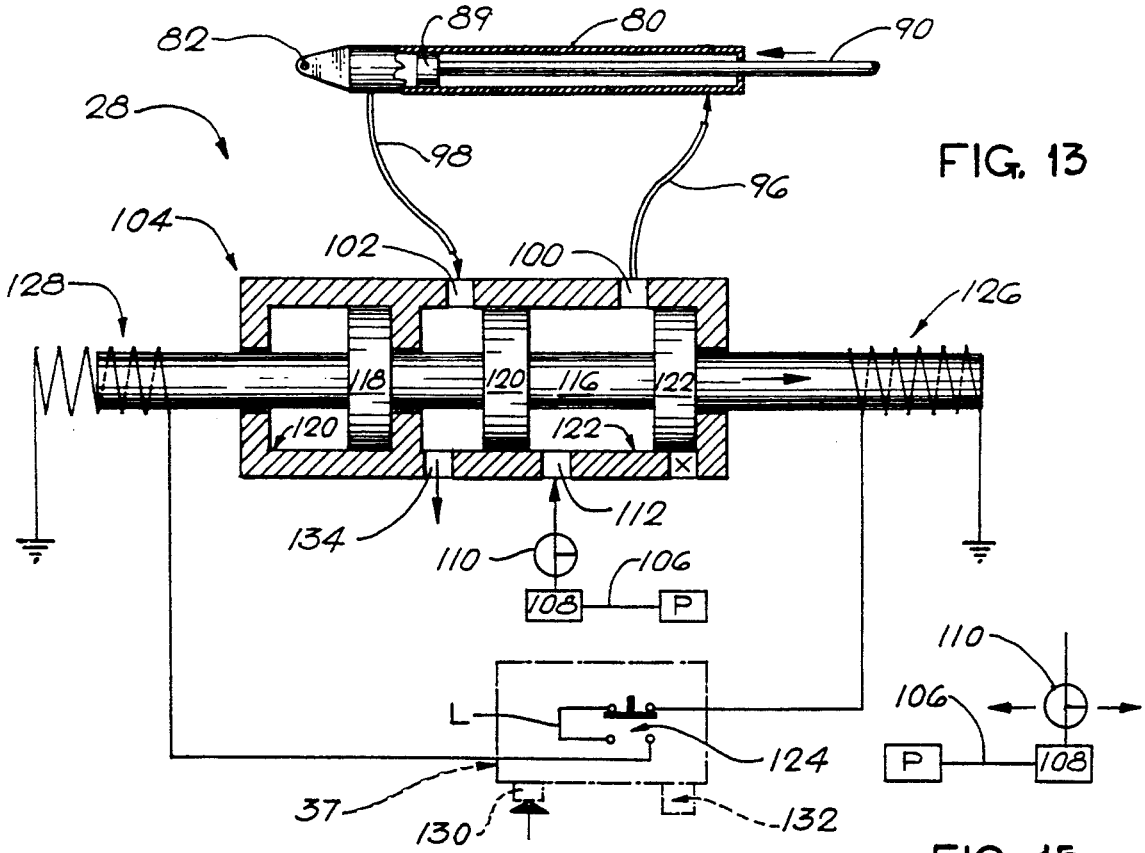
FIG. 13
FIG. 15
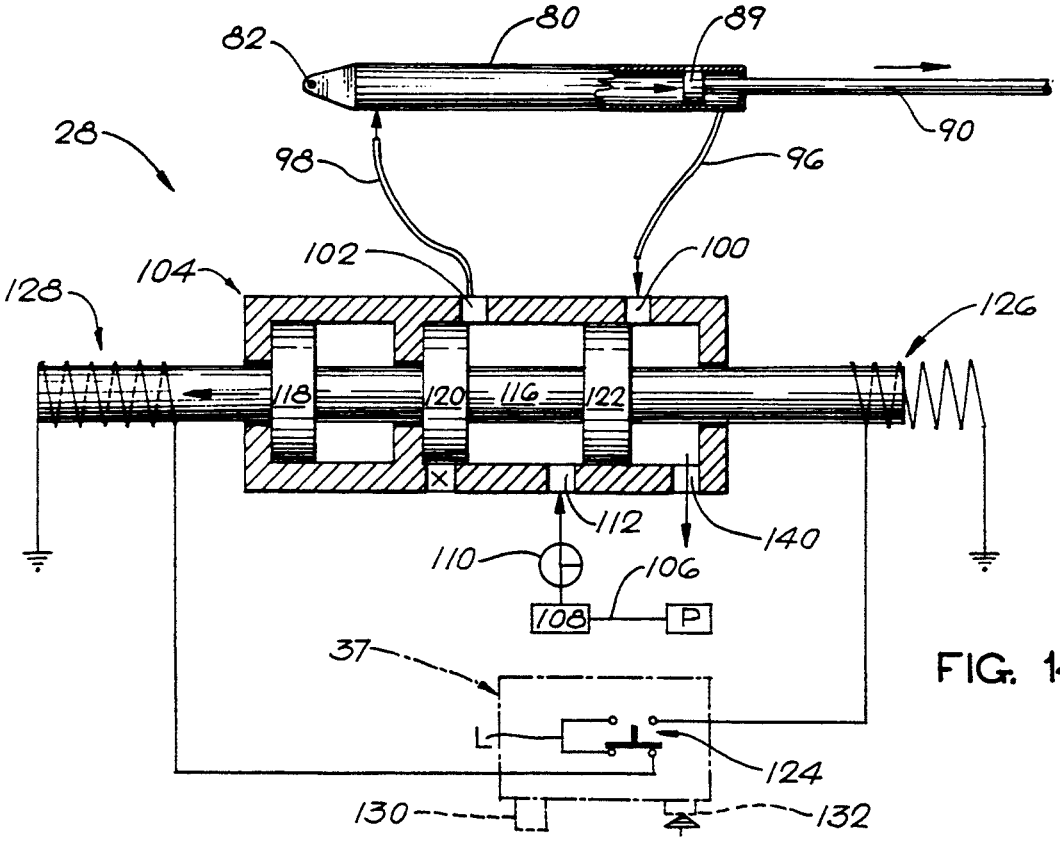
FIG. 14

REMOTELY CONTROLLED TARGET SYSTEM WITH OPTIONALLY SELECTIBLE POWER DRIVES SUCH AS FLUID PRESSURE AND ELECTRICAL POWER DRIVES

BACKGROUND OF THE INVENTION

This invention relates to improvements in or relating target apparatus for use on a firing range.

One such apparatus which is used for target shooting has a plurality of posts mounted at intervals along an elongated base. Each post supports a target board and is rotatably journaled on the base for horizontal swinging movement through an arc of at least ninety degrees. All the target boards are swung simultaneously between a full view working position visible to a shooter, and a ninety-degree-rotated, edge-on working position concealed from the shooter. Each target-supporting post is provided with a lever arm, the lever arms being pivotally interconnected by a drive bar driven by double-acting hydraulic or pneumatic rams which hold the targets against buffers in the face-on and edge-on positions.

An important advantage of rotating the targets by means of hydraulic or pneumatic rams is they are whisper-quiet. A disadvantage however is that air pressure is not always available at target ranges, and hydraulic oil pressure generators are even less available, and hydraulic systems often leak oil. On the other hand, electricity to operate an electric motor is readily available everywhere, even in remote country locations from lightweight, portable gasoline-powered electric generators.

The above-described target system is often used in national and international shooting matches where reliability and continuous operation are critical for comparative scoring between competing shooters. Redundant power sources, preferably two completely different kinds of power would be a distinct advantage, if the switchover from one power system to the other could be accomplished easily.

BRIEF SUMMARY OF THE PRESENT INVENTION

It is a principal object of the present invention to provide a target apparatus which is highly reliable by reason of redundant power sources.

Another object of the invention is to provide such a target apparatus in which the redundant power sources are different, for example, one being pressurized fluid such as hydraulic fluid or compressed air, and the other being electricity.

Another object is to provide a very compact physical arrangement by arranging redundant power sources in an over-and-under arrangement on a base, and connecting them to a common drive means which in turn is itself connected to a plurality of target boards, and means for selectively actuating either power source to simultaneously move all the targets between full view and concealed working positions.

BRIEF DESCRIPTION OF THE DRAWINGS

Other objects and advantages will be apparent from the following description taken in connection with the accompanying drawings in which:

FIG. 13 is a schematic diagram of a preferred form of fluid pressure drive means, in one operative position;

FIG. 14 is a view similar to FIG. 13 showing the fluid pressure drive system in another operative position;

FIG. 15 is a fragmentary view of either FIGS. 13 or 14 showing the three-way valve in vented position;

Like parts are referred to by like reference characters.

DESCRIPTION OF THE PREFERRED EMBODIMENT

Figure 1:
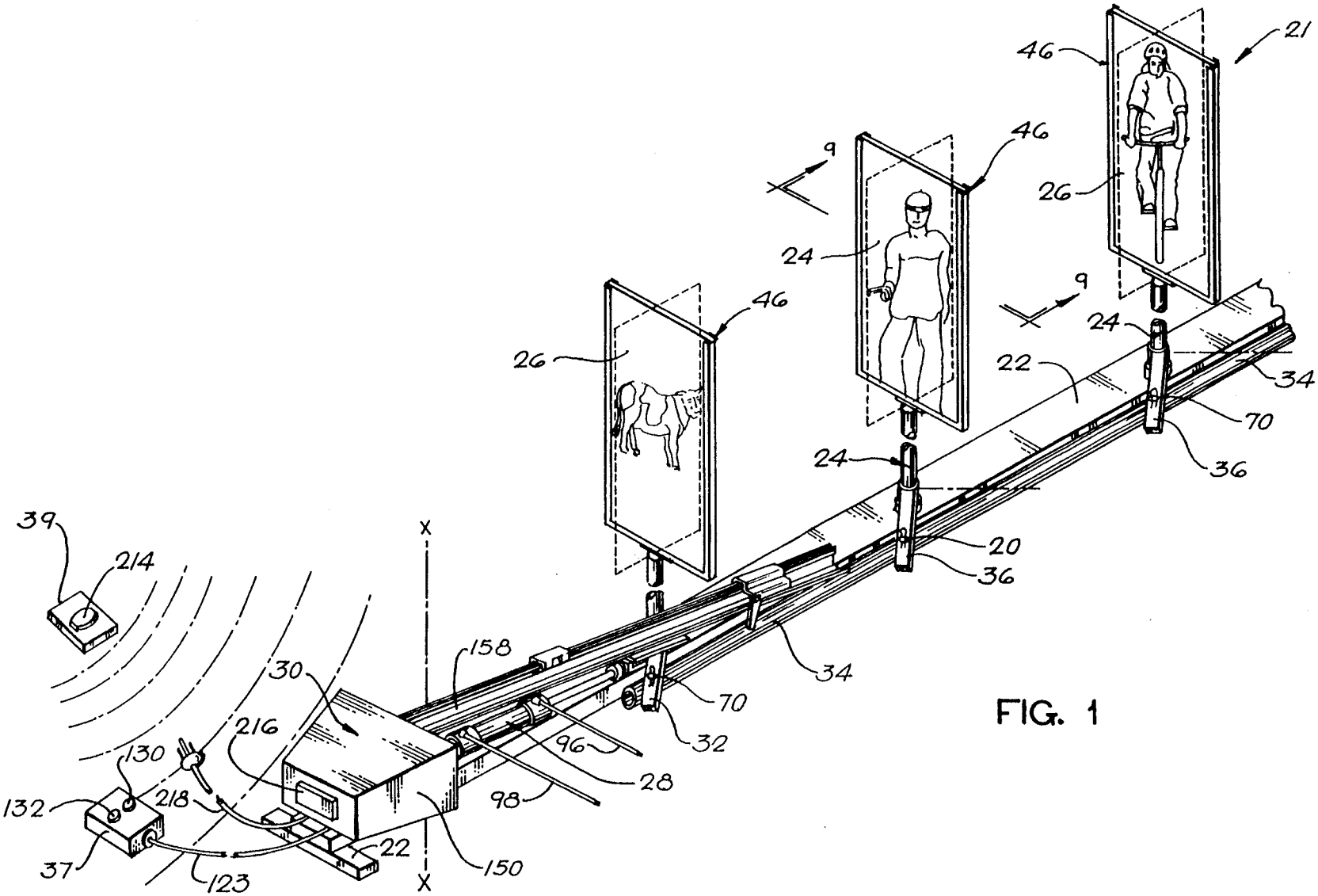
FIG. 1 is a fragmentary perspective view of a remotely controlled target system with optional power drives illustrating one preferred form of the present invention.

Referring now more specifically to the improved target system embodiment shown in the drawings, it is generally designated 21 and comprises: an elongated base 22; a plurality of upstanding posts 24 each being rotatably journaled on the base and supporting a target board 26 for rotation between full view and hidden working positions; alternative fluid pressure drive means 28 and electrical drive means 30 mounted in a compact, over-and-under arrangement and optionally actuatable to move a common drive crank arm 32; and a drive and synchronizing bar 34 pivotally connected to the drive crank arm 32, and to lever arms 36 carried on the posts 24, for simultaneous movement of the target boards 26 with the drive crank arm 32. A remote fluid pressure control unit 37 is provided for the fluid pressure drive means 28; and a remote electric control unit 39 is provided for the electrical drive means 30.

Figures 9, 9A, 10, 11:
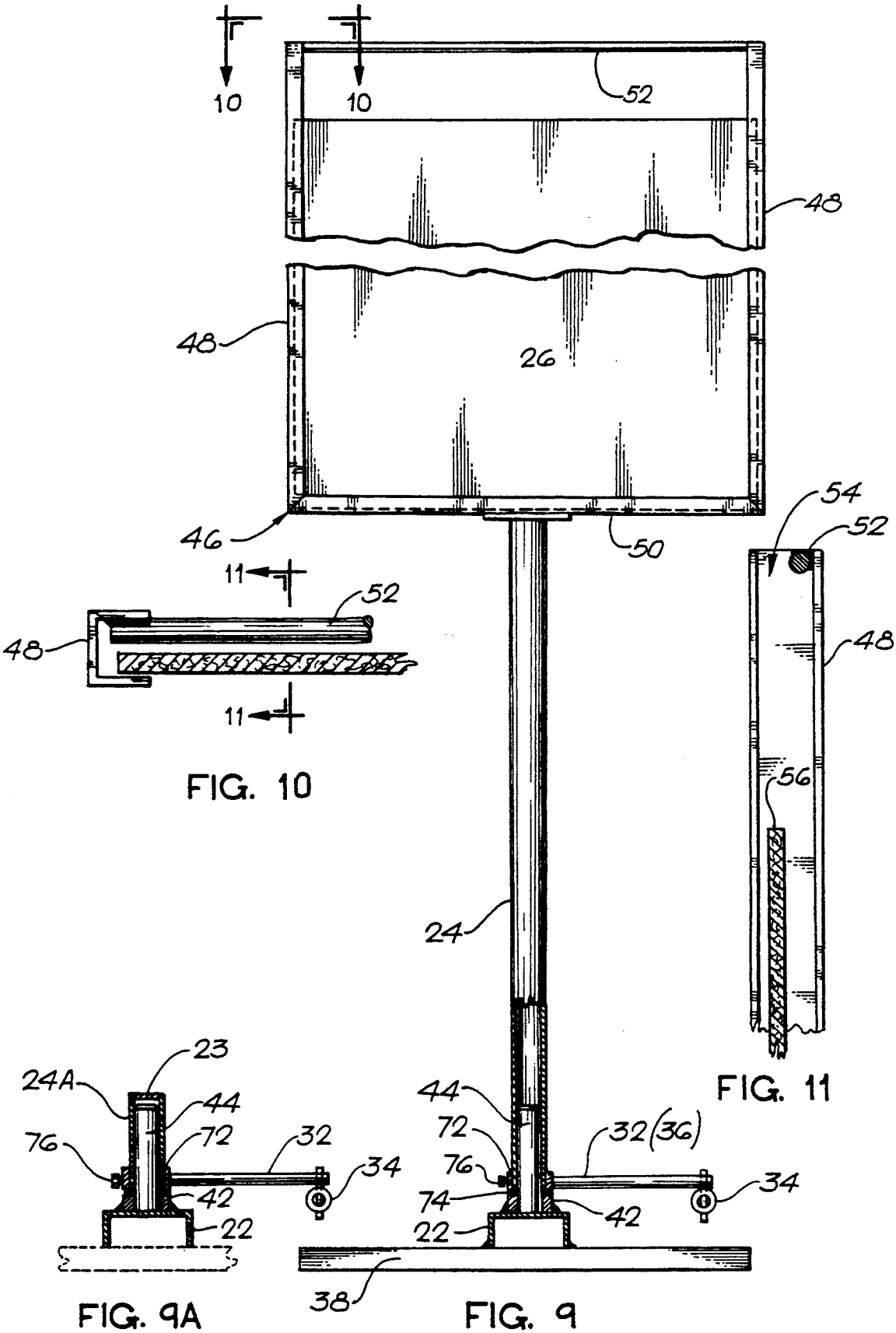
FIG. 9 is an enlarged, fragmentary, composite cross-section of FIG. 2 taken in the direction of both sets of arrows 9—9 and 9—9.
FIG. 9A is a fragmentary view similar to FIG. 9 showing an optional form of the invention.
FIG. 10 is a fragmentary, enlarged view of FIG. 9 taken in the direction of arrows 10—10.
FIG. 11 is a fragmentary, vertical cross-section of FIG. 10 taken along line 11—11.
Figure 12:
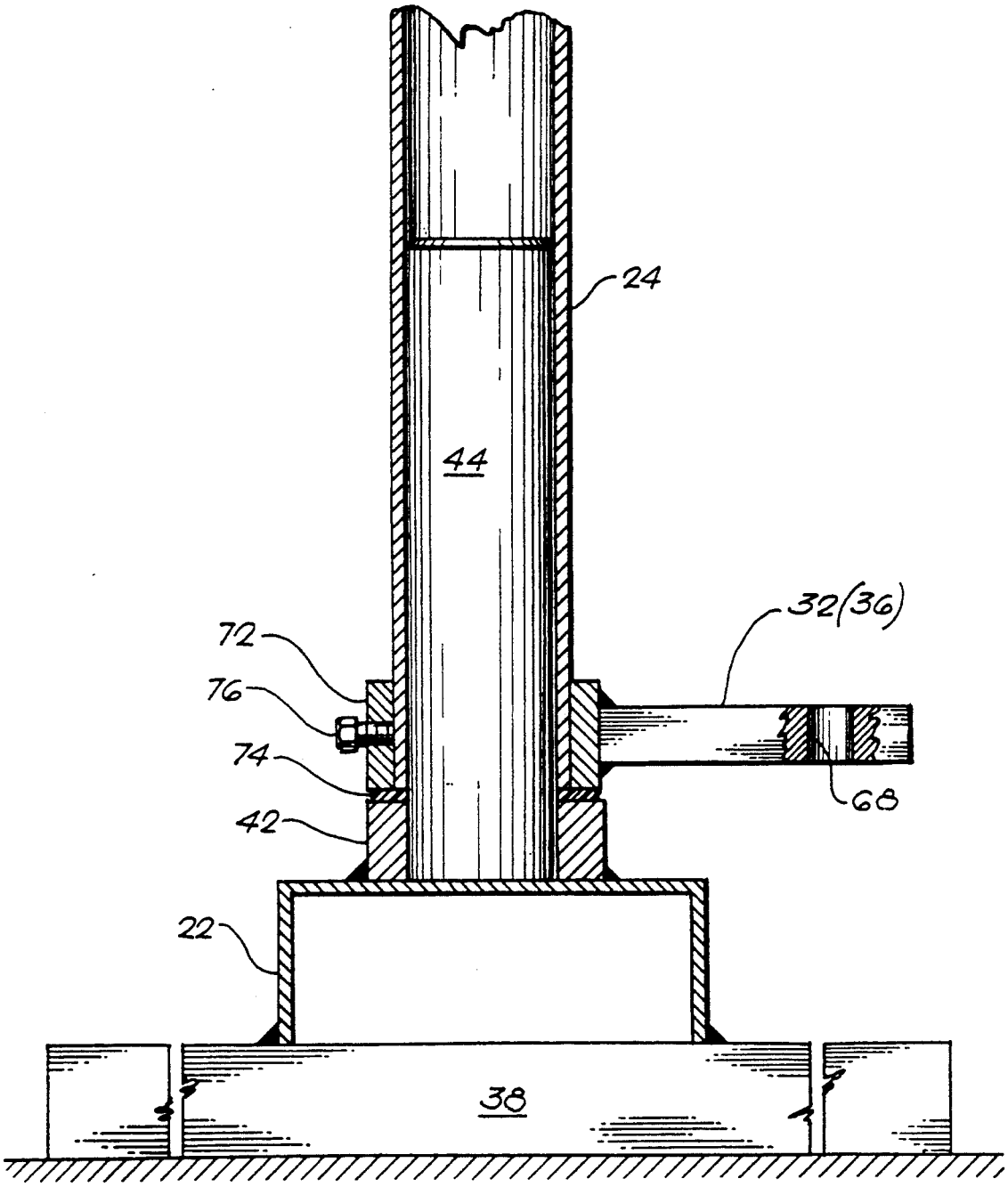
FIG. 12 is a fragmentary, enlarged view of FIG. 9.

As best shown in FIGS. 1, 9 and 12, the base 22 comprises an inverted U-beam secured as by welding at spaced intervals to cross bars 38. As a practical matter, these cross bars will be located at the ends of the U-beams where they are short, and at intervals of about ten feet where the U-beams are relatively long. Referring to FIG. 12, a short vertical collar 42 is secured by welding to the top of the base beam 22, to space the target boards apart typically at intervals of 2 to 4 feet. Fast within each collar, as by a press fit, is a vertical stub shaft 44. Each post 24 is a tube rotatably journaled on one of these stub shafts. At the top of each post 24 is a rectangular target frame 46 consisting of side channel members 48, 48 and bottom channel member 50 with a narrow cross rod 52 extending across the top with an upper opening 54 (FIG. 11) large enough to enable a target display sheet 56 to be inserted in and removed from the frame.

As an alternative to the system shown in FIG. 1, the post 24 and target frame 46 may be omitted at the drive crank arm 32. As shown in FIG. 9A, a short tube 24A with an upper closed end 23 but without any target from secured to it may be substituted for the post 24. This minimizes possibility of damage to drive means 28 or 30 by a stray round.

Figure 17:
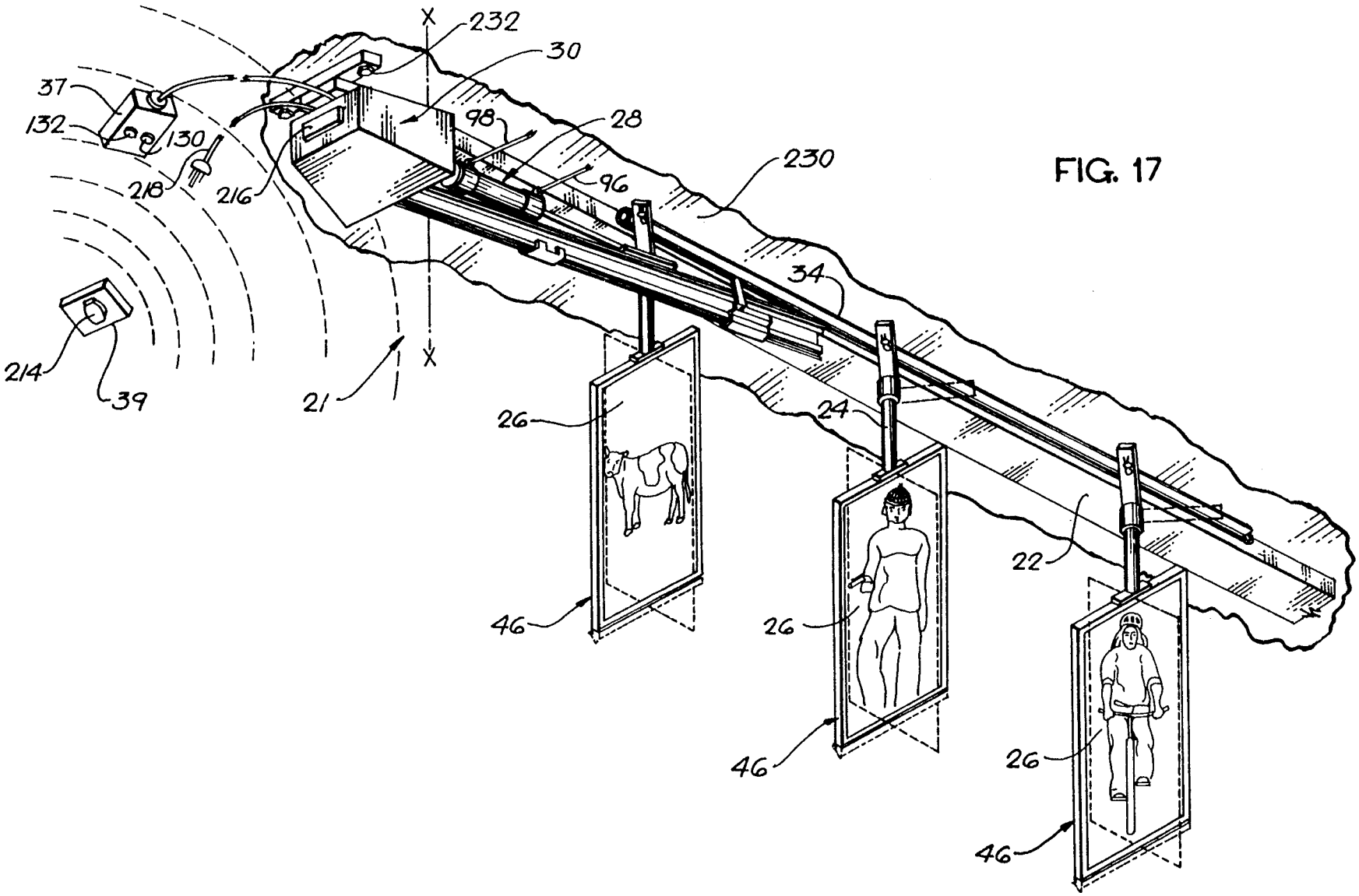
FIG. 17 is a fragmentary perspective view of the remotely controlled target system of FIG. 1 showing it suspended from an overhead or ceiling support.

The target sheets 56 will have a representation of a foe such as the gunman in FIG. 1, or a non-foe (friend) such as the animal and bicyclist in FIGS. 1 and 17 for quick recognition and response by a shooter. Typically, some international standards for pistol target shooting require five targets to be operated simultaneously to face the shooter in full view for a few tenths of a second during which time the shooter must determine which of the targets represent foes and fire an immobilizing round into each while sparing the targets which represent non-foes or friends.

The overall outer dimensions of the drive crank arm 32 and the lever arms 36 are identical in the embodiment shown. All have an outer pivot pin hole 58. The only difference is that the drive crank arm 32 has five additional holes 60, 62, 64, 66 and 68 best shown in FIG. 5, to be described. These additional holes provided a choice of connecting locations for the alternative drives 28 and 30.

The drive and synchronizing bar 34 is connected to the drive crank arm 32 and to the lever arms 36 by pivot pins 70. As best shown in FIG. 12, the drive crank arm 32 is secured as by welding to a collar 72 which is rotatably adjustable about the post 24, and held in a selected adjusted position by a set screw 74 as will be described. A "delrin" plastic or other suitable lubricating thrust bearing washer 74 is seated on the collar 42 beneath the collar 72 and post 24 to facilitate easy rotation of the post and corresponding target frame 46.

Referring to FIGS. 9 and 12, the set screw 76 is threaded through collar 72 to engage the post 24. This enables each target board frame 46 to be rotatably adjusted relative to its respective post 24 to vary the mode of operation. For example, all the target board frames 46 may be rotatably adjusted relative to the posts 24 so they are in the edge view position with the target face out of the shooter's line of sight, as shown in solid lines in FIGS. 1, 2 and 17. In this mode, all the targets will be moved simultaneously to the out-of-sight, solid line, edge view positions, and then simultaneously back to the broken-line, full view positions.

In another mode, alternate target board frames 46 may be rotated ninety degrees relative to the others, all being held in place by the set screws 76. In this mode, half the targets would be moving into view while the other half would be moving out of view.

The alternative drive means 28 and 30 provide redundancy for extreme reliability. While they are shown as different types, that is, fluid pressure and electrical drive means respectively, they could both be the same type.

These alternative drive means will now be described in detail.

Referring first to the fluid pressure drive means 28, this comprises cylinder means 80 pivotally connected at 82 to a bracket 84 supported on an upright bracket 86 which is secured as by bolts 88 (FIGS. 3 and 8) to the top side of base channel member 22.

Figure 2:
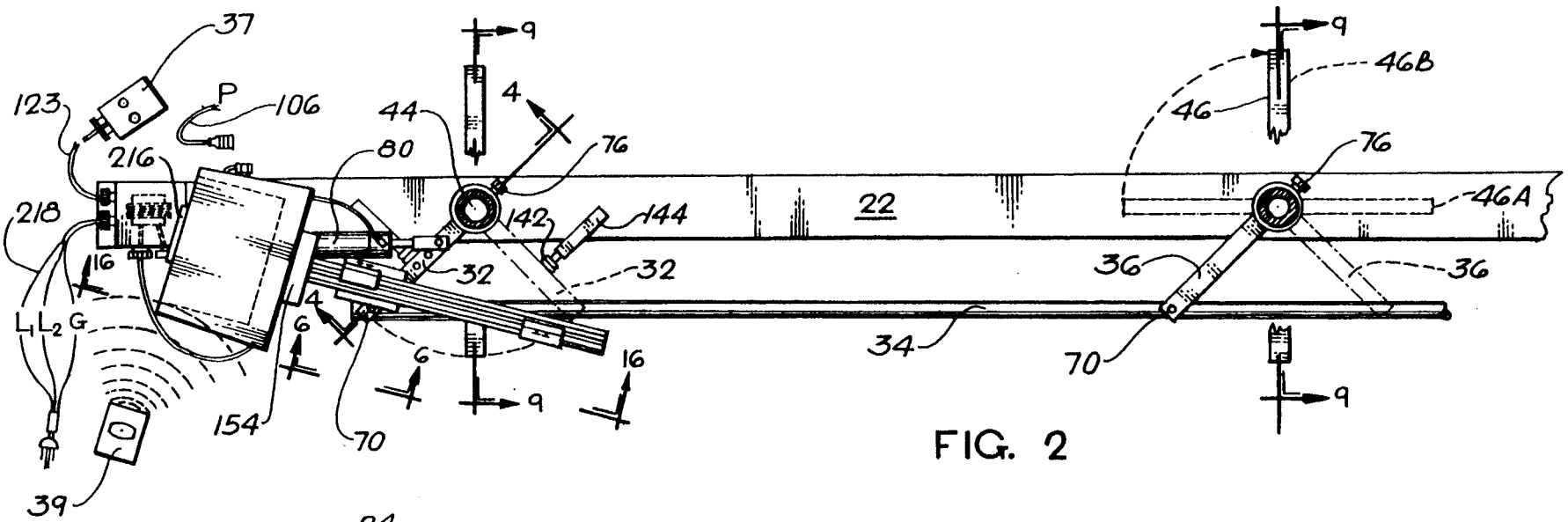
FIG. 2 is a fragmentary, enlarged plan view of FIG. 1.
Figure 5:
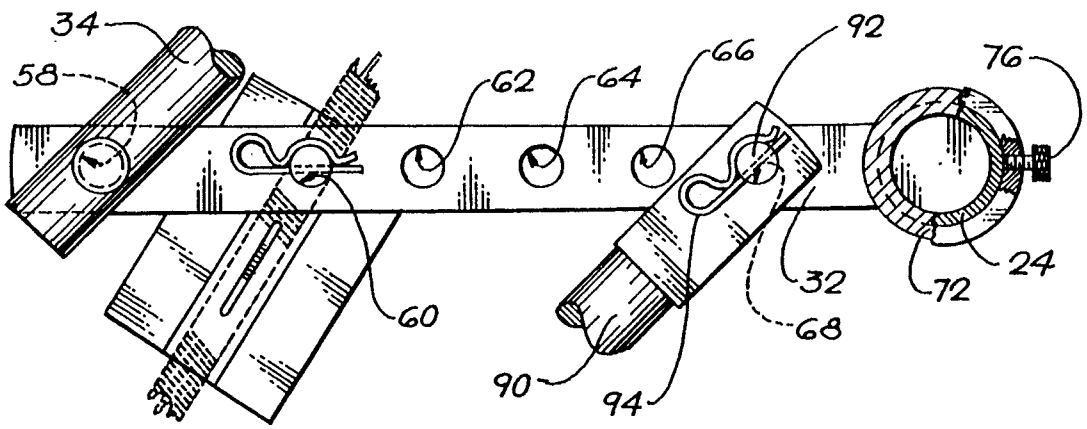
FIG. 5 is an underneath, enlarged, fragmentary view of the drive crank arm 32, an associated components, taken generally in the direction of arrows 5—5 in FIGS. 6 and 7.
Figure 4:
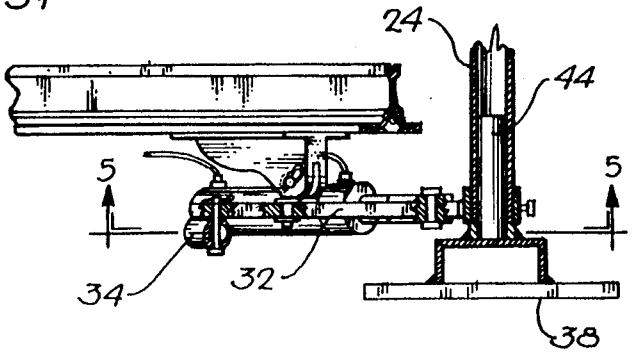
FIG. 4 is a fragmentary enlarged cross-sectional view of FIG. 2 taken along line 4—4.

At the opposite end of the cylinder means 80, a piston rod 90 (FIGS. 3, 5, 13 and 14) is pivotally connected to the drive crank arm 32 by a pin 92 held in opening 68 by a quick-disconnect cotter pin 94 (FIG. 5). A piston 89 (FIGS. 13 and 14) is connected to the piston rod. Opposite ends of the cylinder means 80 are connected by tubes 96, 98 to pressure/return ports 100, 102 respectively of a solenoid operated, four-way valve 104, details of which are illustrated schematically in FIGS. 13 and 14. A pressure supply line 106 is connected to a source P of air under pressure through a quick-disconnect, self-sealing coupling 108 and a main air pressure three-way control valve 110. The coupling is preferably a standard type which automatically seals the pressure line 106 when removed as shown in FIG. 2. An example of such coupling is marketed under the name "MILTON KWIK-CHANGE COUPLER STYLE A".

The control valve 110 has two modes: 1) a working mode shown in FIGS. 13 and 14 directing compressed air into the pressure port 112 of the four-way valve 104; and 2) a venting mode shown in FIG. 15 venting the pressure from the cylinder means 80 to atmosphere through the four-way valve. As will be explained, the venting mode, in effect, disengages or releases the cylinder means 80 from the system, so it will not have any back pressure resisting operation by the electric drive means 30.

Further describing details of the fluid pressure drive means 28, the four-way valve 104 may take any desired form. In the present case (FIGS. 13 and 14) it comprises a casing 114 with a spool 116 having hands 118, 120 and 122 slidably, sealably mounted in bores 120 and 122.

The fluid pressure remote control unit 37 is at the end of a long, remote-control cord 123. The latter contains a two-way electrical switch means 124 (FIGS. 13 and 14), having two operating modes to selectively energize solenoids 126 or 128 to move the spool between the positions shown in FIGS. 13 and 14.

Movement of the targets with the fluid pressure drive means 28 will now be described. The remote control unit 37 has two external buttons 130 and 132. These actuate the switch 124 which is sealed inside unit 37. Pressing button 130 energizes solenoid 126 through upper contacts of switch 124 as shown in FIG. 13. This pulls spool 116 to the right and directs compressed air through valve ports 112 and 100, and line 96, into the rod end of the cylinder means 80 to move the piston 89 to the left as shown in FIG. 13. While the piston is moving leftwise, air is vented from the head end of the cylinder through line 98 and ports 102 and 134 to atmosphere. This moves the piston rod 90 in a contracting direction (leftwise in FIG. 13), moving the drive crank arm 32 to the solid line position shown in FIGS. 1, 2, 3 and 17 against an adjustable stop 136 which is carried by a block 138 secured to the base 22. Bar 34 moves all the target boards 26 synchronously to the edge view, non-visible positions shown in solid lines in FIGS. 1 and 2.

Conversely, pressing button 132 energizes solenoid 128 through lower contacts of switch 124 as shown in FIG. 14. This pulls spool 116 to the left and directs compressed air through valve ports 112 and 102 and line 98 into the head end of the cylinder means 80 to move the piston 89 to the right as shown in FIG. 14. While the piston is moving rightwise, air is vented from the rod end of the cylinder through line 96 and ports 100 and 140 to atmosphere. This moves piston rod 90 in an extending direction (rightwise in FIG. 14), moving the drive crank arm 32 to the broken line position shown in FIGS. 2 and 3 against a second stop 142 which is carried by a block 144 also secured to the top of base 22. Bar 34 moves all the target boards synchronously to the full-view, visible positions shown in broken lines in FIGS. 1, 2 and 16. According to the rules of competitive shooting, the shooter will have only a few tenths of a second to sort out the "friends" on the targets (exemplified by the cow and the bicyclist on the target board from the "foes" (exemplified by the gunman in FIG. 1), and fire off a disabling shot or shots into the latter. In competitive shooting, the switch 124 will be computer-controlled to expose the targets for a predetermined time.

Referring now to alternative electrical drive means 30, this comprises a housing 150 with electric means comprising a reversible electric motor 152 and a gear reducer 154 driving a horizontal screw 156 which is housed within a forwardly extending blade 158.

Figure 3:
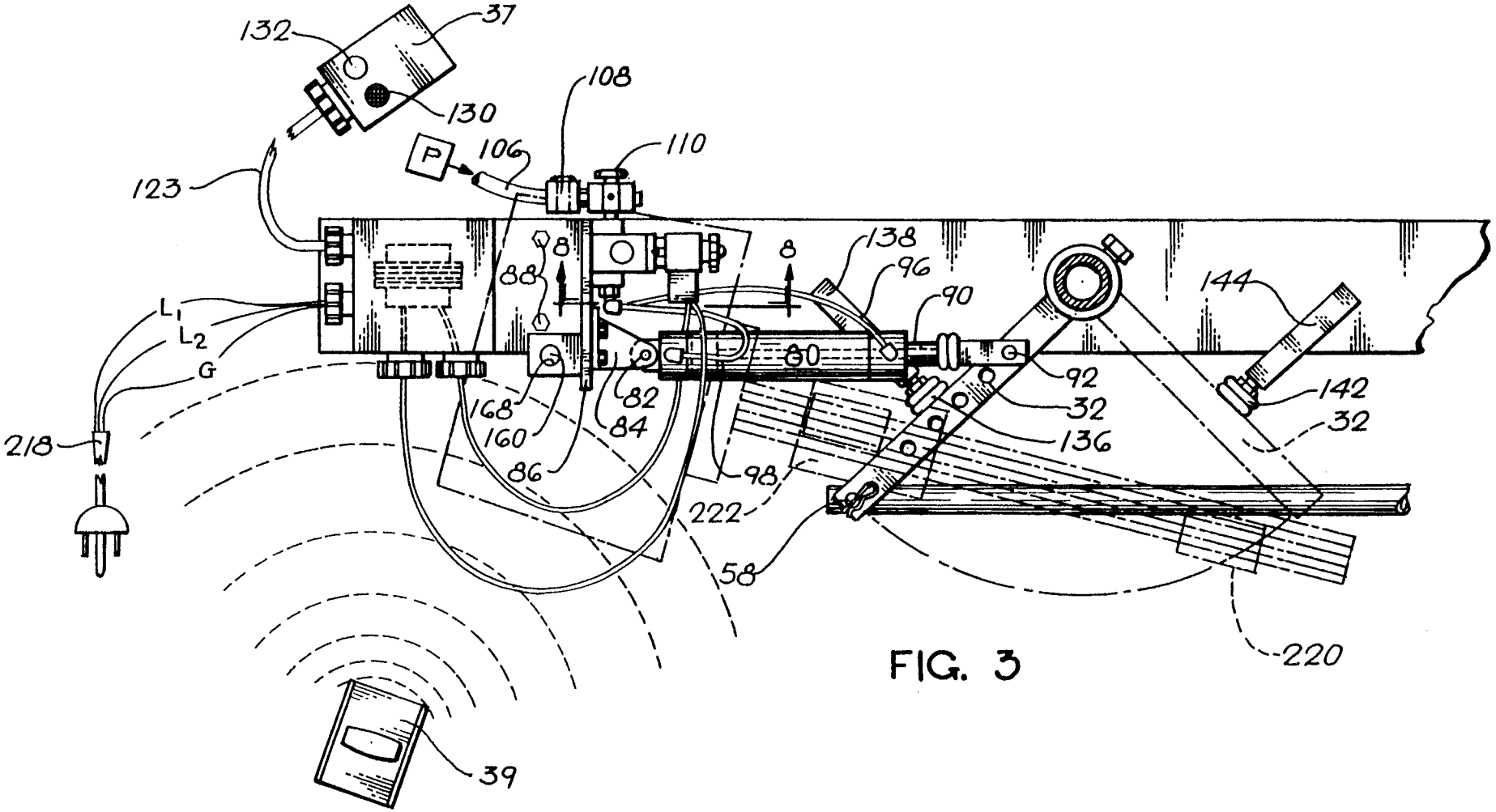
FIG. 3 is a fragmentary, enlarged view of FIG. 2 with portions of the electrical drive means removed to show the underlying, optionally selectible fluid pressure drive means.
Figure 8:
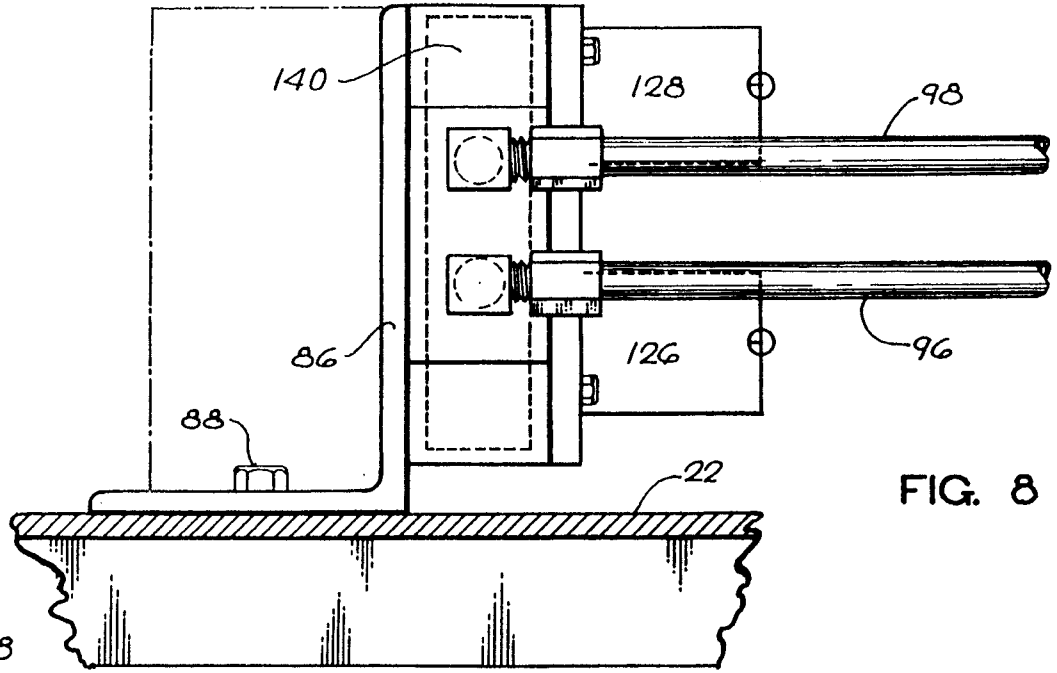
FIG. 8 is an enlarged, vertical cross sectional view of FIG. 3 taken in the direction of arrows 8—8.
Figure 16:
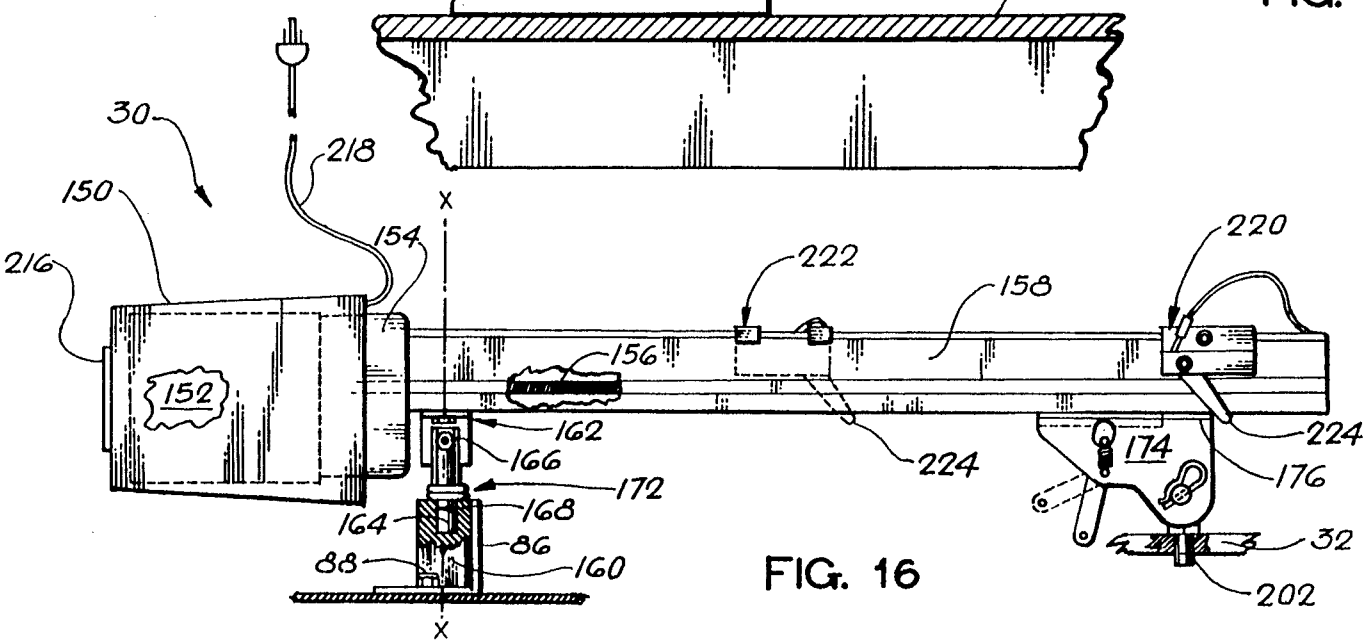
FIG. 16 is a fragmentary elevation view of FIG. 2 taken in the direction of arrows 16—16.

The housing 150 and blade 158 are pivotally mounted about a vertical axis X—X. As shown in FIGS. 3, 8 and 16, a pivot post 160 is secured as by welding to the backside of the upright bracket 86. As best shown in FIG. 16, a clamp 162 is bolted to the underside of the blade 158 just forwardly of the gear box 154 at the approximate center of gravity of the housing and blade. A depending pivot pin 164 is fastened beneath the bracket 162 by a horizontal bolt 166 which enables up and down rocking adjustability about that bolt. The pin 164 is journaled for rotation about the vertical axis X—X, in an upwardly open vertical bore 168 in block 160. A rubber doughnut 172 encircles the pin 164 to provide a resilient support for the electric drive means 30.

Figure 7:
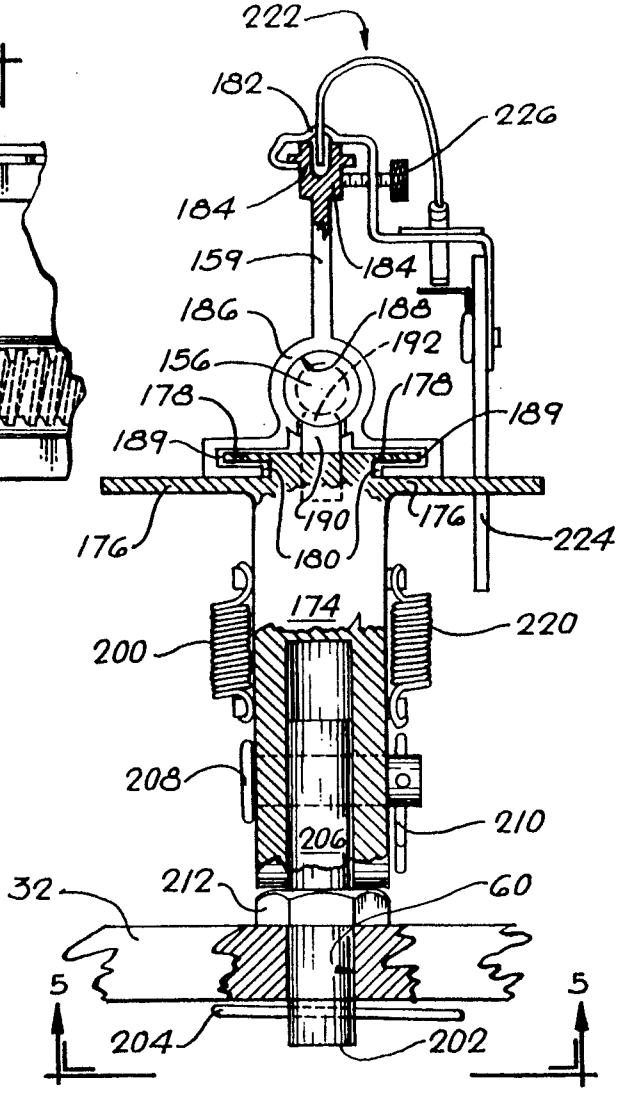
FIG. 7 is an end view of FIG. 6 taken in the direction of arrows 7—7.
Figure 6:
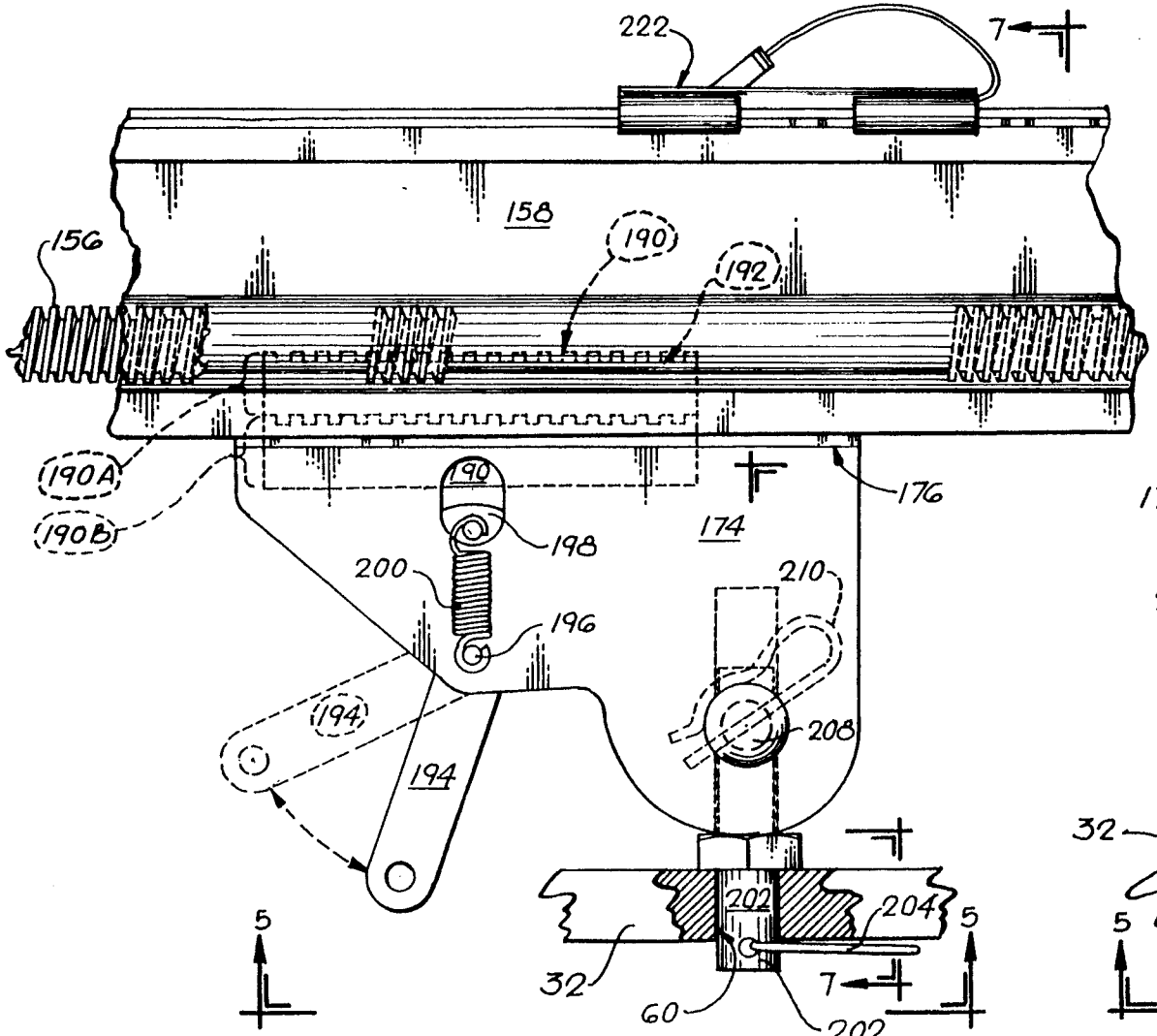
FIG. 6 is a fragmentary, enlarged elevational view of FIG. 2, taken in the direction of arrows 6—6.

As best shown in FIGS. 6, 7 and 16, a traveling block 174 is reciprocably slidable forwardly and backwardly along the underside of the blade 158. As shown in the end view in FIG. 7, the traveling block has two pairs of upper, horizontal flanges 176, 176 and 178, 178 vertically spaced to define grooves 180, 180 between them.

Further, as shown in end view in FIG. 7, the blade 158 has a bifurated upper portion with an upwardly open groove 182 between a pair of horizontally spaced vertical flanges 184, 184. At the bottom portion of the blade, there is an enlarged, tubular section with an inner bore 188 rotatably journaling the screw 156. Internal side grooves 189, 189 act as guides for the upper flanges 178, 178 of the traveling block 174.

A rack 190 is carried by the traveling block for up and down movement between upper and lower positions indicated by the numerals 190A and 190B in FIG. 6. The rack 190 has an upper surface 192 with partial threads or teeth engageable with threads on the outside of screw 156. In position 190A, the partial threads on the rack engage the screw 156 enabling the screw to run the traveling block 174 along the blade in one direction or another depending on the direction of rotation of the motor 152.

In position 190B, the rack 190 disengages the screw so the traveling block can be moved freely along the blade 158 and thereby pose no resistance to movement of the target boards when the alternative, fluid pressure drive means 28 is activated, as will be explained.

As best shown in FIGS. 6 and 7, means is provided in the traveling block 174 for adjustably shifting the rack between its upper, locked position 190A and its lower, unlocked position 190B. A shift lever 194 is pivoted about pin 196 within the traveling block and is moveable between a locked position shown in broken lines and an unlocked position shown in solid lines. Cam mechanism 198 (not completely shown) is provided in the traveling block interconnecting the lever 194 with the rack 190. Any equivalent connecting means may be provided which moves the rack between engaged and disengaged positions 190A and 190B in response to movement of lever 194 between broken line and solid line positions respectively. The rack 190 thus functions in the manner of a jaw clutch, connecting the rack 190 to the screw 156, or releasing them as desired. A pair of external springs 200, 200 are connected between the cam means and the traveling block urging the rack toward its disengaged position 190B.

At the bottom of the traveling block 174, a depending pivot pin 202 is rotatably journaled in hole 60 in drive crank arm 32 and is held by quick-disconnect cotter pin 204. Pin 202 has an upper shank section 206 pivoted to the traveling block about a horizontal pin 208 held by a quick disconnect cotter pin 210. An intermediate, hex collar 212 on the pin 202 supports the pin on the crank arm 32.

The fluid pressure drive means 28 has a smaller range of movement than the electrical drive means 30. That is the range of movement of the piston rod 90 is shorter than that of the traveling block 174, although the actual power exerted by the piston rod can be varied by adjusting the pressure from the power source P. The inherent differences in these ranges of movement can be utilized to provide a very compact over-and-under arrangement of there power sources by connecting the piston rod to a small-radius position on crank drive arm 32, and connecting the traveling block 174 to a larger radius position on arm 32.

An electrical control circuit (only partially shown) for electrical drive means 30 limits movement of the traveling block 174 in forward and rearward directions. The circuit includes forward and rearward limit switches 220 and 222, respectively, which are secured along the blade at preselected positions on opposite sides by set screws 226 (FIG. 7). Each limit switch has an actuating lever 224 which is engageable at the end of the stroke by one of the flanges 176 on the traveling block. In other words, when the screw 156 is driving the traveling block forwardly, one of the flanges 176 engages the lever 224 of forward switch 220. This opens the forward switch and deenergizes the motor, stopping the traveling block at a preselected forward position determined by the location of the forward limit switch. Likewise, in the reverse direction, the other of flanges 176 engages lever 224 on the rear limit switch 222 and deenergizes the motor, stopping the traveling block at a preselected rear position determined by the location of the rear limit switch.

The locations of switches 220 and 222 will be selected to rotate the target boards 90°, as shown in FIGS. 1 and 2.

The remote electric control unit 39 has a button 214 and an internal FM transmitting circuit (not shown) which transmits control signals to an FM receiving antenna 216 schematically illustrated on the back wall of motor housing 150. Alternatively, the receiving antenna may be inside the housing 150. An internal circuit in the housing 150 (not shown), energized by an external electric power cord 218, drives the motor 152 (and screw 156) in opposite directions in response to successive operations of the remote operating button 214. In other words, with batteries properly installed in the remote unit 39, and the power cord 218 plugged into an electrical outlet, pressing button 214, successively, causes motor 152 to rotate screw 156 in one direction and then in the opposite direction to move the traveling block in opposite directions along blade 158. This moves drive crank arm 32 between the solid line and broken line positions shown in FIGS. 2 and 3. This moves the target boards 26 correspondingly between the broken line and solid line positions shown in FIGS. 1, 2 and 17.

The electrical drive means 30 and remote control unit 39 may be likened to components of a garage door opening unit, so it is believed unnecessary to further describe their construction in detail. In fact, an early prototype of the present invention was constructed using a modification of a garage door opening apparatus marketed under the trade name "GENIE".

Use and operation, with the alternative drive means 28 and 30 will now be described.

To operate the target boards 26 solely with the fluid pressure drive means 28, the electrical drive means 30 will first be disengaged or released by moving rack adjustment lever 194 to the unlocked position shown in solid lines in FIG. 6. This lowers the rack 190 to the disengaged position 190B (FIG. 6) thereby disengaging or uncoupling the traveling block 174 from the screw 156 to prevent the traveling block from resisting movement of the target boards by the fluid pressure drive means 28.

Operation with the fluid pressure drive means 28 will now be described. Assume the target boards 26 are in the edge-on positions shown in solid lines in FIGS. 1, 2 and 17. The cylinder means 80 will be in the fully retracted position shown in FIGS. 3 and 13. By pressing button 132 of control unit 37, solenoid 128 is energized through lower contacts of switch 124 as shown in FIG. 14. This pulls spool 116 to the left and directs compressed air from the source P, through valve 110, ports 112 and 102, and line 98 into the head end of cylinder means 80 to move the piston 89 to its fully extended position. While the piston is extending, that is, moving rightwise in FIG. 14, air is vented from the rod end of the piston through line 96; and ports 100 and 140, to atmosphere. This swings the target boards 26 in unison from the solid-line edge view positions to the broken-line full-view positions shown in FIGS. 1, 2 and 17.

The target boards 26 can be returned to the edge-on positions by pressing button 130 of control unit 37. Solenoid 126 is energized through upper contacts of switch 124 as shown in FIG. 13. This pulls spool 116 to the right and directs compressed air from the source P, through valve 110, ports 112 and 100 and line 96, into the rod end of cylinder 80 to move the piston leftwise to its fully retracted position. While the piston is retracting, air is vented from the head end of the piston through line 98, and ports 102 and 134, to atmosphere. This swings the target boards in unison from the broken-line, full-view positions to the solid-line, edge view positions shown in FIGS. 1, 2 and 17.

Operation by the alternative electrical drive means 30 will now be described.

First, the fluid pressure drive means 28 will be disengaged or released, either by removing the quick-disconnect coupling 108 or rotating valve 110 to the vent position shown in FIG. 15. This will vent to atmosphere through valve 110 whichever end of cylinder 80 was last pressurized. The piston 89 is thereby free to move back and forth without the piston resisting movement of the drive crank arm 32 by the electrical drive means.

Next, the shift lever 194 will be moved to the locked position shown in broken lines in FIG. 6. This moves the rack 190 to position 190A engaging the screw 156 as also shown in FIG. 6.

Assume the target boards 26 are in the edge-on position shown in solid lines in FIGS. 1, 2 and 17. The drive crank arm 32 will be in the solid-line position shown in these figures. Likewise, the lever arms 36 on the target board posts 24 will be in corresponding solid line positions.

Pressing button 214 on control unit 39 activates motor 152 and reducer 154 to rotate screw 156 to move traveling block 174 forwardly. This moves the drive crank arm 32 and lever arms 36 simultaneously ninety degrees to the broken-line position shown in FIGS. 2 and 3. This position of the traveling block is shown in FIG. 16 where its flange 176 engages actuator lever 224 of forward limit switch 220. This opens the motor circuit (not shown) by actuating forward limit switch 220, and stops the motor. At this time, the target boards 26 have been turned ninety degrees to the full-view broken line positions shown in FIGS. 1 and 2.

Button 214 will pressed once more to reverse the motor and return the target boards to the edge-view, solid line positions. This moves the traveling block 174 rearwardly along the blade 158 until one of the flanges 176 engages the rear limit switch 222. This moves the drive crank arm 32 and lever arms 36 simultaneously ninety degrees to the solid line positions shown in FIGS. 1, 2, 3 and 17. Limit switch 222 opens the motor energization circuit (not shown) thereby stopping the motor. At this time the target boards 26 have been turned ninety degrees to the edge-view, solid line positions.

The present invention may be embodied in other specific forms without departing from its spirit or essential characteristics. For example, the target system 21 may be suspended from a ceiling or other overhead support 230, by bolts 232, as shown in FIG. 17. The present invention is therefore to be considered illustrative and not restrictive, the scope of the invention being indicated by the appended claims and not by the foregoing description, and all modifications and variations which would come within the meaning and range of equivalency of the claims are intended to be covered by them.

The embodiments of the invention in which an exclusive property or privilege is claimed are defined as follows:

1. In a target system, an elongated horizontal base, a plurality of posts journaled for rotation at spaced intervals along the base, each post supporting a target board having at least one target face and being rotatable through an arc of at least ninety degrees to rotate the corresponding target board between a full view working position in which the target face is visible to a shooter, and an edge view working position in which the target face is concealed from the shooter, each post having a lever arm extending outwardly therefrom, an elongated connecting bar extending along the base and pivotally connected to each of the lever arms to synchronize rotation of the target boards between said working positions, remote controlled optional dual power mechanisms for rotating the target boards comprising in combination:

a drive crank arm pivotally movable on the base for horizontal swinging movement;

means pivotally connecting the elongated connecting bar to the drive crank arm to swing the target boards between said working positions in response to swinging movement of the drive crank arm;

optionally selectible first and second power drive means mounted on the base, each power drive means having a reciprocable drive member connected to the drive crank arm;

first and second remote control means for said first and second power drive means respectively, located at a distance remote from the target boards, said first remote control means being operable to actuate the first power drive means to swing the drive crank arm in opposite directions to move the target boards between said working positions, said second remote control means being operable to actuate the second power drive means to swing the drive crank arm in opposite directions to also move the target boards between said working positions; and first release means selectively adjustable to release the first power drive means from the drive crank arm during actuation of the drive crank arm by the second power drive means, and second release means selectively adjustable to release the second power drive means from the drive crank arm during actuation of the drive crank arm by the first power drive means.

2. In a target system, the combination of claim 1 in which the reciprocable drive members of the first and second power drive means are pivotally connected to the drive crank arm.

3. In a target system, the combination of claim 1 in which the reciprocable drive members of the first and second power drive means are connected to the drive crank arm at different radial distances from the center of pivotal movement of the drive crank arm.

4. In a target system, the combination of claim 1 in which the first power drive means comprises a housing pivotally mounted on the base and having elongated blade means, reversible electric motor means in the housing and traveling block means reciprocably supported on the blade means by the electric motor means and pivotally connected to the drive crank arm.

5. In a target system, the combination of claim 4 in which one of the release means comprises means for selectively disengaging the electric motor means from the traveling block means.

6. In a target system, the combination of claim 5 in which said first power drive means comprises screw means extending along said blade means and being rotatable by the electric motor means in opposite directions under control of said first remote control means, said traveling block means includes rack means engageable with said screw means to reciprocate said traveling block means along said blade means in response to rotation of said screw means, and said means for selectively disengaging the electric motor means from the traveling block means comprises means for disengaging said rack means from said screw means.

7. In a target system, the combination of claim 1 in which said second power drive means comprises:

cylinder means acting between the base and the drive crank arm and operable in response to pressurized fluid to move said target boards between said working positions;

and operating valve means connected between said cylinder means and a source of pressurized fluid, said operating valve means being moveable between first and second positions to direct pressurized fluid selectively into opposite ends of said cylinder means to move the target boards between said working positions;

said second remote control means being effective to selectively move the operating valve means between its said first and second positions; and said second release means comprises means for disconnecting the source of pressurized fluid from the operating valve means and for venting the cylinder means to prevent pressurized fluid in the cylinder means from interfering with movement of the target boards by the first power drive means.

8. In a target system, the combination of claim 1 in which said first and second power drive means are arranged in a compact, over-and-under relationship on the base.

9. In a target system, the combination of claim 7 in which said operating valve means has solenoid means for moving said operating valve means between its said first and second positions under the control of said second remote control means.

10. In a target system, the combination of claim 7 in which said means for disconnecting the source of pressurized fluid comprises three-way valve means connected between the operating valve means and the source of pressurized fluid, said three-way valve means being moveable between a pressure position connecting the source of pressurized fluid to the operating valve means, and a release position blocking flow from the source of pressurized fluid while venting pressure from the cylinder means.

11. In a target system, the combination of claim 7 in which said means for disconnecting the source of pressurized fluid comprises a quick-disconnect, self-sealing coupling in a pressure line leading from the source of pressurized fluid to the operating valve means.

12. In a target system, an elongated horizontal base, a plurality of posts journaled for rotation at spaced intervals along the base, each post supporting a target board having at least one target face and being rotatable through an arc of at least ninety degrees to rotate the target board between a full view working position in which the target face is visible to a shooter, and an edge view working position in which the target face is concealed from the shooter, each post having a lever arm extending outwardly therefrom, an elongated connecting bar extending along the base and pivotally connected to each of the lever arms to synchronize rotation of the target boards between said working positions, remote controlled optional dual power mechanisms for rotating the target boards comprising in combination:

a drive crank arm pivotally moveable on the base for horizontal swinging movement;

means pivotally connecting the elongated connecting bar to the drive crank arm to swing the target boards between said working positions in response to swinging movement of the drive crank arm;

optionally selectible electrical drive means and fluid pressure drive means mounted in a compact over-and-under relation on the base for moving the target boards through the drive crank arm, connecting bar and lever arms;

said electrical drive means comprising a housing mounted on the base and an elongated blade carried by the housing, reversible electrical motor means in said housing, a reciprocable traveling block connected to the drive crank arm, and connecting means enabling the motor means to drive the traveling block back and forth along the blade, said connecting means including clutch means actuatable between an engaged mode in which the motor means moves the traveling block, and a disengaged mode enabling the traveling block to be moved freely along the blade by the drive crank arm without back resistance from the motor means;

an electrical remote control unit located remotely from the target system and selectively operable to actuate the motor means to drive the traveling block along the blade;

said fluid pressure drive means comprising cylinder means acting between the base and the drive crank arm and operable in response to a source of pressurized fluid to oscillate said drive crank arm, connecting bar, and lever arms;

reversing valve means acting between a fluid pressure source and opposite ends of the cylinder means being selectively activateable to direct fluid under pressure to either end of the cylinder means while venting the opposite end to move said drive crank arm and components connected to it in a selected direction;

pressure and venting control means located between the fluid pressure source and the cylinder means and being activateable to a fluid power mode, in which the reversing valve means is connected to the fluid power source, and activateable to a venting and blocking mode, in which the cylinder means is vented to atmosphere and blocked from the fluid pressure source thereby enabling the cylinder means to be moved by the drive crank arm without back resistance from residual pressure in the cylinder means;

a fluid pressure remote control unit located remotely from the target system and selectively operable to actuate the reversing valve means to move the drive crank arm in one direction or the other;

whereby the target system can be remotely operated exclusively by the electrical remote control unit by placing said clutch means in its said engaged mode while simultaneously placing the pressure and venting control means in its said venting and blocked mode; and whereby further, the target system can be remotely operated exclusively by the fluid pressure remote control unit by placing the pressure and venting control means in said fluid power mode while simultaneously placing said clutch means in said disengaged mode.

13. In a target system, the combination of claim 12 in which the pressure and venting control means comprises a quick-disconnect, self-sealing coupling between the fluid pressure source and the reversing valve means.

14. In a target system, the combination of claim 12 in which the pressure and venting control means comprises a three-way valve between the fluid pressure source and the reversing valve means.

15. In a target system, the combination of claim 12 including pivotal connections between the housing and the base and between the traveling block and the drive crank arm.

16. In a target system, the combination of claim 12 including pivotal connections between the cylinder means and the base, and between the cylinder means and the drive crank arm, respectively.

* * * * *